US007740058B2

(12) United States Patent
Koepke et al.

(10) Patent No.: US 7,740,058 B2
(45) Date of Patent: Jun. 22, 2010

(54) PLATE HEAT EXCHANGER

(75) Inventors: Andreas Koepke, Filderstadt (DE); Reinhard Wehrmann, Reutlingen (DE)

(73) Assignee: Modine Manufacturing Company, Racine, WI (US)

( * ) Notice: Subject to any disclaimer, the term of this patent is extended or adjusted under 35 U.S.C. 154(b) by 274 days.

(21) Appl. No.: 11/866,516

(22) Filed: Oct. 3, 2007

(65) Prior Publication Data

US 2008/0236802 A1 Oct. 2, 2008

(30) Foreign Application Priority Data

Oct. 12, 2006 (DE) ..... 10 2006 048 305

(51) Int. Cl.
*F28F 3/06* (2006.01)
*F28F 9/24* (2006.01)

(52) U.S. Cl. ..... 165/167; 165/174; 165/916

(58) Field of Classification Search ..... 165/153, 165/167, 174, 916
See application file for complete search history.

(56) References Cited

U.S. PATENT DOCUMENTS

| | | | | |
|---|---|---|---|---|
| 2,251,066 | A | 7/1941 | Persson et al. | |
| 2,591,878 | A | 4/1952 | Rogers et al. | |
| 3,240,268 | A | 3/1966 | Armes | |
| 3,255,817 | A | 6/1966 | Davids et al. | |
| 3,532,161 | A | 10/1970 | Lockel | |
| 4,002,201 | A | 1/1977 | Donaldson | |
| 4,407,359 | A | 10/1983 | Berger et al. | |
| 4,470,455 | A | 9/1984 | Sacca | |
| 4,479,533 | A | 10/1984 | Persson et al. | |
| 4,976,313 | A | 12/1990 | Dahlgren et al. | |
| 4,987,955 | A | 1/1991 | Bergqvist et al. | |
| 5,184,673 | A * | 2/1993 | Hedman et al. | 165/153 |
| 5,462,113 | A | 10/1995 | Wand | |

(Continued)

FOREIGN PATENT DOCUMENTS

| | | |
|---|---|---|
| DE | 19709601 | 9/1998 |

(Continued)

*Primary Examiner*—Leonard R Leo
(74) *Attorney, Agent, or Firm*—Michael Best & Friedrich LLP

(57) ABSTRACT

The invention relates to a plate heat exchanger, composed of trough-shaped heat exchanger plates which are stacked one in the other and whose edges bear against one another. The plates can have flow ducts, located between the heat exchanger plates for a cooling fluid and for another fluid. The flow ducts are fitted with inserts in the form of turbulator plates. The heat exchanger can include at least four inlet and outlet openings in the corners of the heat exchanger plates which form two vertical ducts for the cooling fluid and two vertical ducts for the other fluid in the stack. The inserts in the flow ducts for the cooling fluid are embodied in one part or a plurality of parts. The flow ducts for the cooling fluid are equipped, in the regions around the openings, with plate-like inserts which have guide ducts with a width, and are provided with the turbulator plate in a central region between the plate-like inserts. The openings can be arranged right in the corners in such a way that only a narrow strip remains, which is occupied by a guide duct which is formed in the plate-like inserts and which has a significantly smaller width than the width of the other guide ducts.

12 Claims, 4 Drawing Sheets

U.S. PATENT DOCUMENTS

| | | | | |
|---|---|---|---|---|
| 5,538,077 | A | 7/1996 | So et al. | |
| 5,964,280 | A | 10/1999 | Wehrmann et al. | |
| 6,039,112 | A * | 3/2000 | Ruppel et al. | 165/167 |
| 6,460,613 | B2 * | 10/2002 | Nash et al. | 165/153 |
| 6,530,425 | B2 * | 3/2003 | Wehrmann et al. | 165/167 |

FOREIGN PATENT DOCUMENTS

| | | | | |
|---|---|---|---|---|
| EP | 0819906 | 1/1998 | | |
| EP | 0819907 | 1/1998 | | |
| EP | 1152204 | 11/2001 | | |
| GB | 2054817 A * | 2/1981 | | 165/167 |
| WO | 9429659 | 12/1994 | | |
| WO | 9535474 | 12/1995 | | |

* cited by examiner

PLATE HEAT EXCHANGER

CROSS-REFERENCE TO RELATED APPLICATIONS

Priority is hereby claimed to German Patent Application No. DE 10 2006 048 305.7, filed Oct. 12, 2006, the entire contents of which is incorporated herein by reference.

FIELD OF THE INVENTION

The present invention relates to a plate heat exchanger and a method of assembling the same.

SUMMARY

German Patent No. DE 197 09 601 A1 discloses a conventional plate heat exchanger. In its flow ducts it has turbulence plates (i.e., lamellas), which are divided into sections in order to reduce the pressure loss. The sections are always composed of the same type of turbulence plates, the sections being rotated through 90° in each case with respect to the adjacent section. They are matched to one another in shape in such a way that no gaps are produced. Nevertheless, as has become apparent, the overall pressure loss is undesirably high and the internal pressure stability is in need of improvement.

EP 1 152 204 B1 discloses a plate heat exchanger having horizontal flow ducts intended for the coolant and an additional plate located between two heat exchanger plates. This additional plate includes longitudinal beads of any shape which serve to deflect or guide the fluid. As a result, uniform distribution of the heat exchanging fluid over the entire heat exchanger plate is achieved. In addition, the additional plate improves the internal pressure stability and also the resistance to changing temperature stress of the heat exchanger. However, this configuration has the disadvantage that the fluid in the central region of the heat exchanger has a largely laminar flow. For this reason, the exchange of heat is not optimum and could be improved.

The invention of the present application makes available a plate heat exchanger which is optimized in terms of the pressure loss and the heat exchanging efficiency without at the same time adversely affecting the internal pressure stability and resistance to changing temperature stress. The solution according to the present invention is obtained by a plate heat exchanger.

It is proposed that in each case that an insert which, in regions around the openings, has plate-like sections in which guide ducts having a width (B) are formed for the cooling fluid. The insert can include a turbulence generator in a central region between the plate-like sections. The openings can be arranged in the corners in such a way that only a narrow strip remains, which is occupied by a guide duct which has a significantly smaller width (b) than the width (B) of the other guide ducts.

The proposed inserts may be formed as one piece. This is appropriate for very high numbers of heat exchangers since a corresponding tool entails costs. However, they are preferably formed with at least three parts, with in each case two plate-like inserts which have the guide ducts being provided in a flow duct, and with at least one turbulence generator being arranged in the central region. This measure which is preferred here is more advantageous for relatively small numbers of heat exchangers. In addition, different thicknesses of sheet metal plates can be used, that is to say for example the plate-like inserts can be made slightly thicker than the starting material (sheet-metal strip) for the turbulence generator.

Because the flow ducts for the cooling fluid are equipped in the regions around the openings with plate-like inserts or sections which have guide ducts, the internal pressure stability is comparatively improved since the plate-like inserts or sections make available larger surfaces which are soldered, welded, or brazed to the adjoining heat exchanger plates. At the same time, the pressure loss is kept moderate because less turbulence occurs in the aforementioned regions. In addition, because a lamella is arranged as a turbulence generator in a central region between the plate-like inserts or sections, the heat exchanging efficiency is improved because comparatively more turbulence is generated in the central region. Because the openings are arranged right in the corners to such an extent that only a narrow strip remains, which is occupied with a guide duct which is formed in the plate-like inserts or sections and which has a substantially smaller width compared to the other guide ducts, the entire heat exchanging surface is enlarged by comparison or at least involved better in the exchange of heat, which has positive effects on efficiency.

In order to make a contribution to quality assurance when manufacturing the plate heat exchanger, a positioning aid, for example a projection, can also or alternatively be provided on at least one opening edge of the plate-like inserts. The positioning aid engages in a groove at the edge of the inlet or outlet opening. Incorrect stacking of the heat exchanger plates or of the plate-like inserts is prevented. The positioning aids can be formed on the edge of those openings which are assigned to the flow duct for the cooling fluid.

A further advantage of forming a guide duct in the aforementioned narrow strip has proven to be that the quality of the soldering, welding, or brazing in the corner regions was improved. This is due to the fact that the guide duct present there has clearly restricted what is referred to as the "sagging" of the corners at a soldering, welding, or brazing temperature and under the effect of a force which is directed at the plates of the plate heat exchanger during the soldering, welding, or brazing process. The guide duct opposes this force with a component and therefore makes the corners more dimensionally stable. This can also be understood if it is considered that the height of the flow ducts is only a few millimeters, sometimes only between 1 and 2 mm. The narrow strips which are formed with a guide duct have approximately a quarter circle shape. The guide ducts are partially formed from a shaped edge of the plate-like inserts or sections and partially by the edge of two heat exchanger plates. A one-part lamella is located in the flow ducts for the other fluid. In the case of an oil cooler, the other flow ducts are those for the oil.

Other aspects of the invention will become apparent by consideration of the detailed description and accompanying drawings.

BRIEF DESCRIPTION OF THE DRAWINGS

The invention is described below in an exemplary embodiment, in relation to which reference is made to the appended drawings, in which.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
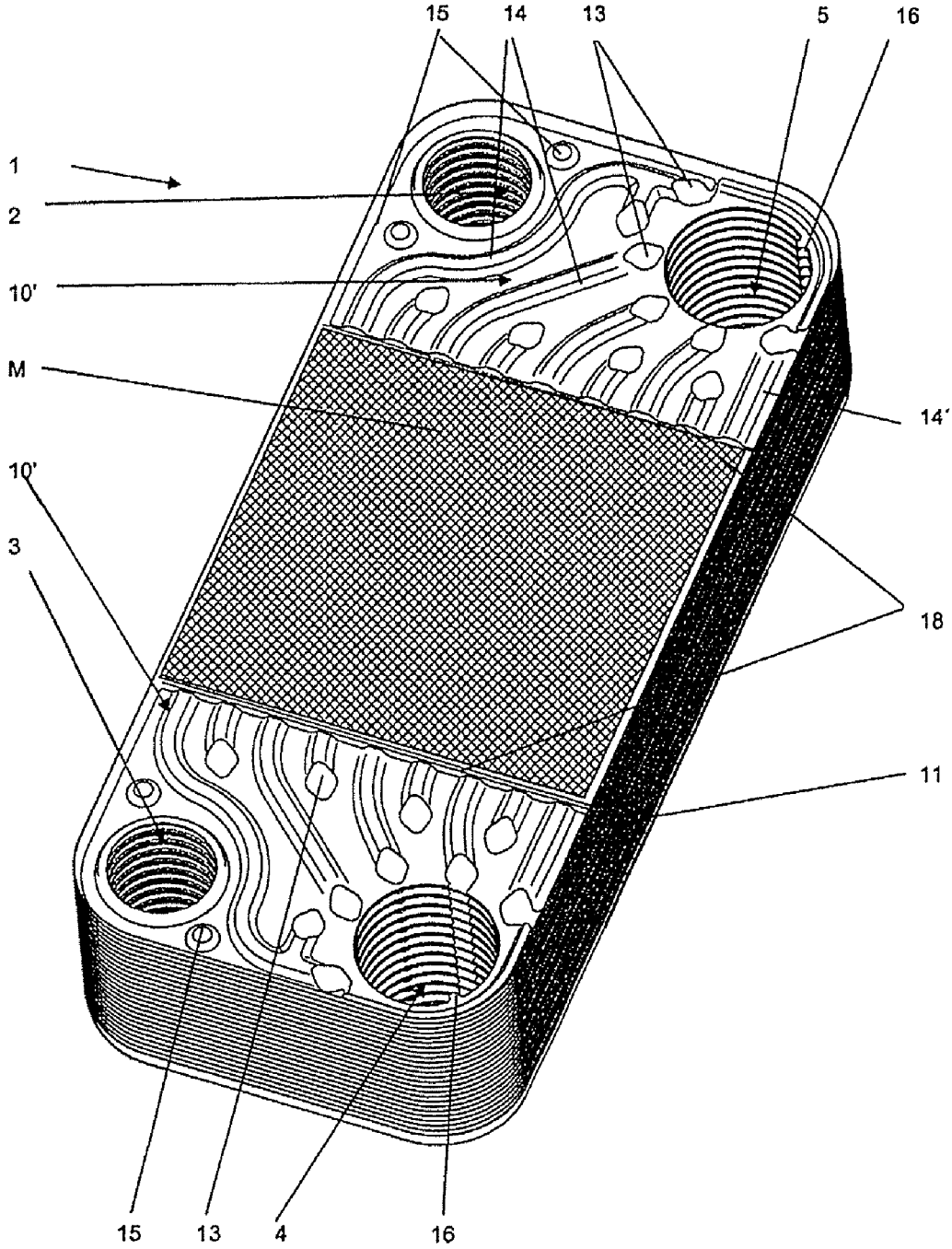
FIG. 1 is a perspective view of an "open" plate heat exchanger.
Figure 2:
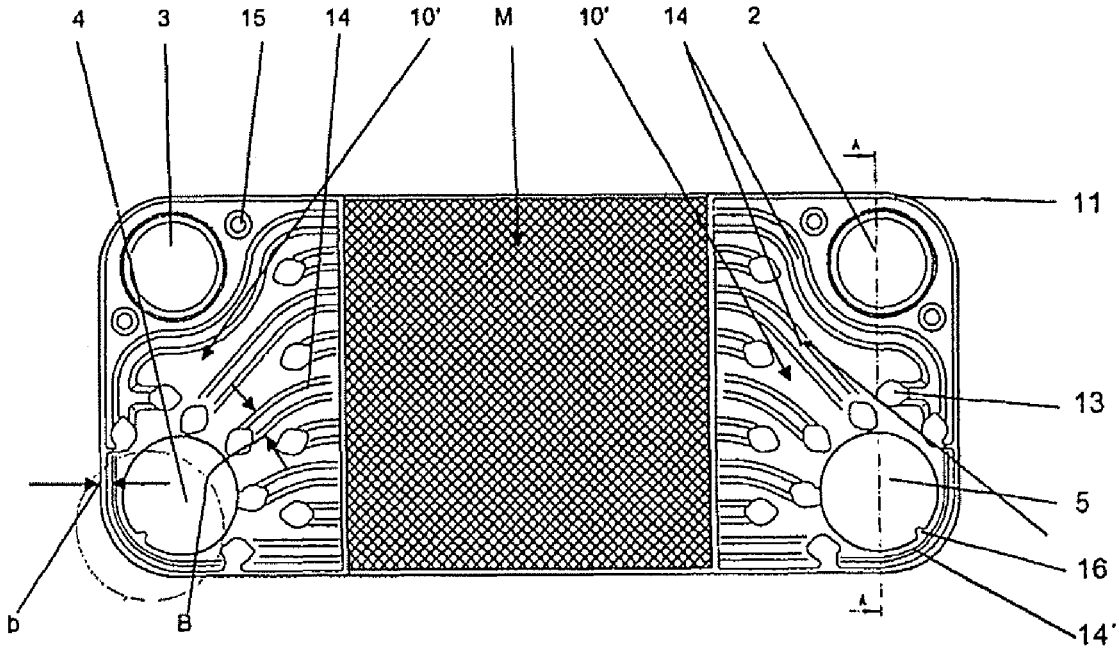
FIG. 2 is a plan view of the plate heat exchanger according to FIG. 1.

FIG. 1 shows a perspective view of a plate heat exchanger 1, which can be an oil cooler, but which could also serve other heat exchanging or heat transferring purposes. The heat exchanger 1 has been illustrated in an open view, i.e. without upper end plates or housing plates. In particular, FIGS. 1 and 2 show the interior of a flow duct 31 through which a first fluid (e.g., a coolant) flows. In addition, the heat exchanger 1 can include trough-shaped heat exchanger plates 11 with upturned edges 111 bearing against the upturned edges 111 of adjacent plates 11. Flow ducts 31 for a liquid coolant are formed between adjacent pairs of heat exchanger plates 11. Other flow ducts 32 for a second fluid, such as, for example, oil can also be seen.

The inlet and outlet openings 2, 3, 4 and 5 in the heat exchanger plates 11 form ducts which run perpendicularly to the aforementioned flow ducts 31, 32. The coolant and the oil pass into the heat exchanger 1 through connectors 30 located at the top or bottom of the heat exchanger 1, and the coolant and the oil also exit the heat exchanger 1 again in this manner. Some or all of the connectors 30 can optionally be arranged either on the top plate or bottom plate, or alternatively, the connectors 30 can be distributed on the bottom plate and on the top plate, depending on the requirements of the installation location or of the machine assembly.

Turbulence insert elements 19 are provided as inserts 10 in the flow ducts 32 for the oil (and are not shown). Plate-like inserts 10' and a turbulence insert element 19 are used for the coolant in the flow ducts 31.

An exemplary embodiment having one-piece inserts 10' has not been shown. In this exemplary embodiment, the inserts are plate-like sections of the one-piece inserts which may correspond to the plate-like inserts 10' (shown and described in more detail below). A central region M is embodied as a turbulence generator with corresponding ribbing or the like. The exemplary embodiment shown has three-piece inserts 10'.

Figure 6:
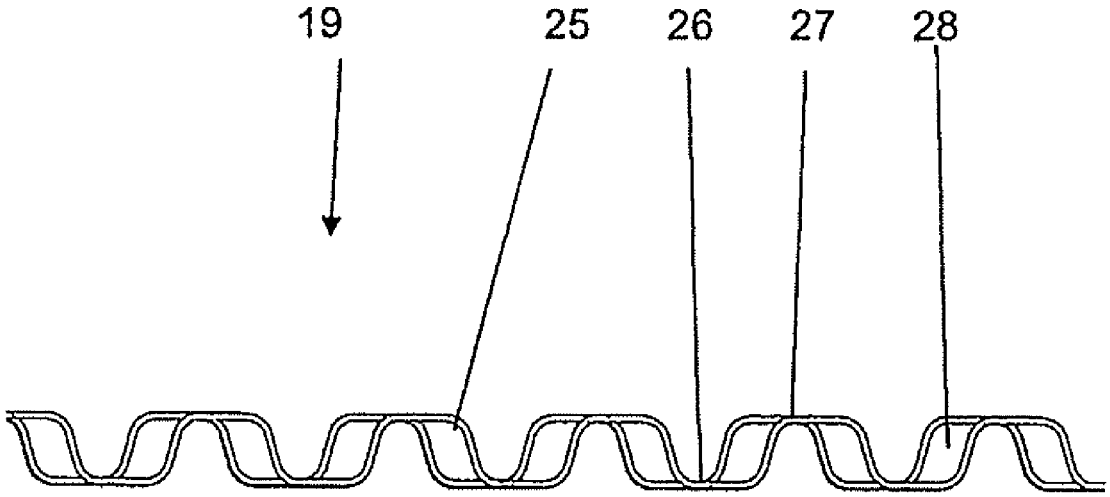
FIG. 6 shows a detail of a lamella.

FIG. 1 shows that in the region of the inlet and outlet openings 3 and 4, as well as 2 and 5, a plate-like insert 10' is arranged in each case. The turbulence insert element 19 has been inserted between them in the central region M, as is shown in FIG. 6. However, it is also possible to use any other shape of turbulence insert element. All of the inserts 10, 10', 19 can be easily manufactured and easily inserted to minimize manufacturing costs. All the parts can be manufactured from planar metal sheets. They are given the shape shown here by suitable shaping processes.

Flow-directing guide channels 14 with inflow and outflow means 13 are made in the plate-like inserts 10'. In addition, knobs or protrusions 15, which are arranged in the vicinity of the inlet opening or outlet opening 2 of the heat exchanger plate 11, serve to stabilize the internal pressure and produce a certain degree of turbulence. The guide ducts 14 can have branches. In the three-part embodiment, they end at the edges 18, which are adjoined by the turbulence insert element 19.

FIG. 2 is a plan view of a heat exchanger plate 11 with three inserted inserts 10' and 19. It is clearly apparent here how the guide ducts 14 with their inflow openings 13 take up the coolant and conduct it to the turbulence plate 19. The pressure loss is thus kept to a minimum and at the same time the exchange of heat is maximized. This has also made possible through the skilful and surprisingly simple combination of the inserts 10' and 19. The turbulence plate 19 can be inserted in such a way that the corrugation 25 is perpendicular to the direction of flow of the coolant.

Figure 3:
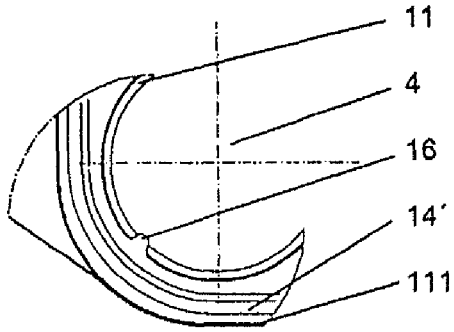
FIG. 3 shows a detail from FIG. 2.
Figure 4:
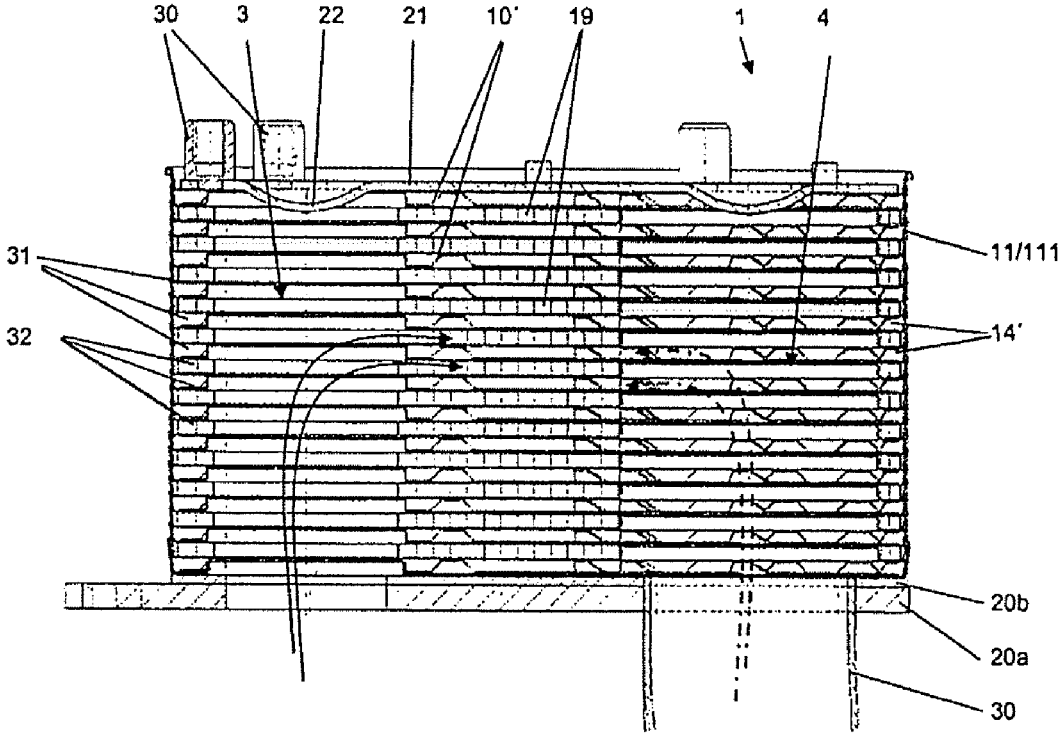
FIG. 4 shows a section through the narrow side of part of the plate heat exchanger.

A positioning aid 16 has been embodied at the openings in the inserts 10' which are assigned to the inlet opening 4 and the outlet opening 5 for the coolant. It is intended to prevent the insert 10' from being incorrectly positioned, which would give rise to a functionally inoperable plate heat exchanger. FIG. 3 shows the positioning aid 16 in detail. FIG. 4 shows a vertical section through the narrow side of the heat exchanger 1. A section through the ducts 3 and 4 is also illustrated.

The upper terminating plate 21 forms the upper termination of the heat exchanger 1 in the region of the ducts 3 and 4 includes indents 22. These serve to stabilize the pressure. Here, the connectors 30 are shown. The heat exchanger 1 is attached by means of a connecting plate 20*a*. A reinforcement plate 20*b* is located between the heat exchanger 1 and the connecting plate 20*a*. The terminating plate 21, the connecting plate 20*a* and the reinforcement plate 20*b* are thicker than the heat exchanger plates 11. Depending on the application in the vehicle, the various plates can have a different sheet metal thickness. The arrows are intended to indicate the flow of the two fluids.

Figure 5:
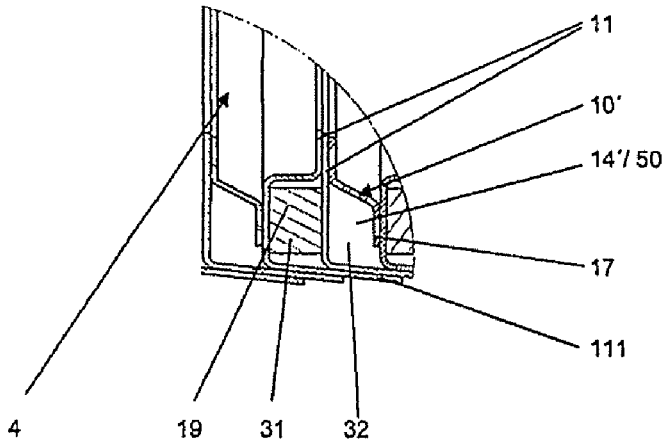
FIG. 5 shows the detail from FIG. 4.

FIG. 5 shows a detail of a corner region of the heat exchanger 1. It is principally aimed at clarifying the design of the guide channel 14' which extends in a narrow strip 50. It is clearly shown how the edges 111 of the trough-shaped heat exchanger plates 11 engage one in the other and ensure that the heat exchanger 1 is soldered, welded, or brazed in a sealed manner. The guide duct 14' also serves to stabilize the heat exchanger 1 during the soldering, brazing, or welding process.

In the corners in which the inlet and outlet openings 2, 3, 4, 5, the heat exchanger plates of conventional heat exchangers frequently gave way during the soldering, brazing, or welding process. The particular feature here is that the flow is guided in the guide duct 14' both by means of a bent over edge 17 of the insert 10' and by the edge 111 of the heat exchanger plate 11. This guide duct 14' has a width b which is less than the width B of the other guide ducts 14 in the inserts 10'. In order to optimize the area which is available for exchanging heat, the inlet and outlet openings 2, 3, 4, 5 are placed right into the corners of the heat exchanger plates 11.

FIG. 6 shows a section through the turbulence insert elements 19. They have a corrugation 25 with corrugation peaks 27 and corrugation troughs 26. In addition, sections 28, which cause the corrugation 25 to be displaced at regular intervals, are provided in the flanks of the corrugations. It is thus possible to generate optimum turbulence which permits an optimum transfer of heat. Various features and advantages of the invention are set forth in the following claims.

What is claimed is:

1. A plate heat exchanger comprising:

a plurality of stacked trough-shaped heat exchanger plates having edges bearing against one another, having at least four inlet and outlet openings in the corners of the heat exchanger plates which form two vertical ducts for a cooling fluid and two vertical ducts for a second fluid in the stack, and providing flow ducts located between the heat exchanger plates for the cooling fluid and for the second fluid, the flow ducts being fitted with inserts;

wherein at least one of the inserts includes plate-like sections including the openings and a plurality of guide ducts with a width formed to receive the cooling fluid, and a turbulence generator in a central region between the plate-like sections;

wherein the openings are arranged in the corners in such a way that only a narrow strip remains between each opening and a respective edge, the narrow strip including a guide duct which has a significantly smaller width than the width of the other guide ducts.

2. The plate heat exchanger of claim 1, wherein each insert is formed as a single piece.

3. The plate heat exchanger of claim 1, wherein each insert is formed from at least three parts, wherein two plate-like sections which have the guide ducts are provided, and at least one turbulator plate is arranged as a turbulence generator in the central region.

4. The plate heat exchanger of claim 1, wherein a projection is formed on at least one edge of the plate-like inserts to serve as a positioning aid during assembly.

5. The plate heat exchanger of claim 4, wherein the projection engages in a groove on the edge of an inlet or outlet opening.

6. The plate heat exchanger of claim 1, wherein positioning aids are formed on the edge of the openings assigned to the flow duct for the cooling fluid.

7. The plate heat exchanger of claim 1, wherein the narrow strip formed with the guide duct has an approximately quarter circle shape.

8. The plate heat exchanger of claim 1, wherein approximately half of each of the guide ducts are formed from a shaped edge of the insert, and an other half is formed by the edge of the two heat exchanger plates between which the insert is located.

9. The plate heat exchanger of claim 1, wherein the guide ducts each have an inlet opening and an outlet opening, an arcuate profile and are aligned with the two openings in the heat exchanger plates which provide the flow duct with the coolant.

10. The plate heat exchanger of claim 9, wherein the inlet openings or the outlet openings are located approximately on a straight line on one side of the inserts, and at various distances in front of the openings on the other side.

11. The plate heat exchanger of claim 10, wherein the straight line lies in each case at the junction with the central region, and is approximately perpendicular to the longitudinal side of the heat exchanger plates.

12. The plate heat exchanger of claim 1, wherein a one-piece turbulator plate is arranged in the flow ducts for the other fluid.

* * * * *